US010440486B2

(12) United States Patent
Solum et al.

(10) Patent No.: US 10,440,486 B2
(45) **Date of Patent: *Oct. 8, 2019**

(54) METHODS AND SYSTEMS FOR LOADING HEARING INSTRUMENT PARAMETERS

(71) Applicant: Starkey Laboratories, Inc., Eden Prairie, MN (US)

(72) Inventors: Jeffrey Paul Solum, Greenwood, MN (US); Gregory John Haubrich, Champlin, MN (US); Brent Anthony Bauman, Minneapolis, MN (US); Stephen Paul Flood, Eden Prairie, MN (US); Thomas Howard Burns, St. Louis Park, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/154,201

(22) Filed: Oct. 8, 2018

(65) Prior Publication Data

US 2019/0149931 A1 May 16, 2019

Related U.S. Application Data

(63) Continuation of application No. 14/854,730, filed on Sep. 15, 2015, now Pat. No. 10,097,937.

(51) Int. Cl.
*H04R 25/00* (2006.01)

(52) U.S. Cl.
CPC ..... *H04R 25/70* (2013.01); *H04R 25/554* (2013.01); *H04R 25/552* (2013.01); *H04R 25/75* (2013.01);

(Continued)

(58) Field of Classification Search
CPC ..... H04R 25/30; H04R 25/305; H04R 25/55; H04R 25/552; H04R 25/554; H04R 25/70;

(Continued)

(56) References Cited

U.S. PATENT DOCUMENTS 6,549,633 B1 4/2003 Westermann
7,496,205 B2 2/2009 Kühnel (Continued)

OTHER PUBLICATIONS

"U.S. Appl. No. 14/854,730, Final Office Action dated Mar. 13, 2018", 9 pgs.

(Continued)

*Primary Examiner* — Joshua Kaufman
(74) *Attorney, Agent, or Firm* — Schwegman Lundberg & Woessner, P.A.

(57) ABSTRACT

Methods and systems are described for transferring programming information to a hearing instrument. Such programming information may include hearing loss compensation parameters and/or other information pertaining to device operation. In one embodiment, each of a pair of hearing instruments prescribed and configured for a particular hearing loss contains the necessary information for operation on either the left or right ear. The data from one hearing instrument may then be transferred to the other hearing instrument by means of wireless communication. In other embodiments, programming information is transferred wirelessly by an external device connected to a database.

19 Claims, 3 Drawing Sheets

(52) U.S. Cl.
CPC ..... *H04R 2225/39* (2013.01); *H04R 2225/51* (2013.01); *H04R 2225/55* (2013.01)

(58) Field of Classification Search
CPC ..... H04R 2225/39; H04R 2225/51; H04R 2225/55
See application file for complete search history.

(56) References Cited

U.S. PATENT DOCUMENTS

| | | | | |
|---|---|---|---|---|
| 7,672,468 | B2 | 3/2010 | Kaiser et al. | |
| 8,180,079 | B2 | 5/2012 | Bindner | |
| 8,467,553 | B2 | 6/2013 | Schefer | |
| 8,605,913 | B2 | 12/2013 | Schwerdtner | |
| 10,097,937 | B2 | 10/2018 | Solum et al. | |
| 2009/0052706 | A1* | 2/2009 | Gottschalk | H04R 25/305 381/314 |
| 2010/0111338 | A1* | 5/2010 | Ypma | H04R 25/552 381/314 |
| 2012/0148054 | A1* | 6/2012 | Rank | H04R 25/552 381/23.1 |
| 2014/0023216 | A1 | 1/2014 | Solum et al. | |
| 2015/0201284 | A1* | 7/2015 | Park | H04R 25/30 381/323 |
| 2016/0112811 | A1* | 4/2016 | Jensen | H04R 5/033 381/17 |
| 2017/0078809 | A1 | 3/2017 | Solum et al. | |

OTHER PUBLICATIONS

"U.S. Appl. No. 14/854,730, Non Final Office Action dated Apr. 20, 2017", 10 pgs.
"U.S. Appl. No. 14/854,730, Non Final Office Action dated Nov. 2, 2017", 11 pgs.
"U.S. Appl. No. 14/854,730, Notice of Allowance dated Jun. 7, 2018", 7 pgs.
"U.S. Appl. No. 14/854,730, Response filed Jul. 20, 2017 to Non Final Office Action dated Apr. 20, 2017", 8 pgs.
"U.S. Appl. No. 14/854,730, Response filed Feb. 2, 2018 to Non Final Office Action dated Nov. 2, 2017", 8 pgs.
"U.S. Appl. No. 14/854,730, Response Filed May 11, 2018 to Final Office Action dated Mar. 13, 2018", 6 pgs.
"U.S. Appl. No. 14/854,730, Response Restriction Requirement dated Oct. 14, 2016", 7 pgs.
"U.S. Appl. No. 14/854,730, Restriction Requirement dated Oct. 14, 2016", 5 pgs.

* cited by examiner

METHODS AND SYSTEMS FOR LOADING HEARING INSTRUMENT PARAMETERS

CROSS-REFERENCE TO RELATED APPLICATION

This application is a continuation of U.S. patent application Ser. No. 14/854,730, filed Sep. 15, 2015, now issued as U.S. Pat. No. 10,097,937, which is incorporated by reference herein in its entirety.

FIELD OF THE INVENTION

This invention pertains to electronic hearing instruments, hearing instrument systems, and methods for their use.

BACKGROUND

Hearing instruments such as hearing aids are electronic devices that compensate for hearing losses by frequency selectively amplifying and compressing sound. The electronic components of a hearing instrument may include a microphone for receiving ambient sound, processing circuitry for processing the microphone signal in a manner that depends upon the frequency and amplitude of the microphone signal, an output transducer or receiver for converting the amplified microphone signal to sound for the wearer, and a battery for powering the components. Hearing instruments may also incorporate wireless transceivers for enabling communication with an external device and/or communication between two hearing instruments worn by a user.

DETAILED DESCRIPTION

Hearing instruments such as hearing aids are programmed with custom parameters for each side of a patients head. For those patients who wear a pair of hearing instruments, each hearing instrument is designated as either a left or right hearing instrument. If a patient loses or damages a hearing instrument that requires full replacement, the patient typically obtains the replacement hearing aid though a dispenser or audiologist since they are uniquely programmed for each side of a patient's head. The new hearing instrument would then have to be programmed for the patient's specific hearing loss and feature preferences that correspond to the hearing instrument that was replaced.

Described herein are methods and systems for allowing a patient to receive a generic hearing instrument directly from the factory or from a dispenser or audiologist without having to go in for a refitting or reprogramming. In one embodiment, each of a pair of hearing instruments prescribed and configured for a particular hearing loss contains the necessary information for operation on either the left or right ear. The data from one hearing instrument may then be transferred to the other hearing instrument by means of wireless communication. In that way, the hearing instrument wearer could receive a generic replacement hearing instrument directly from the factory which could be worn immediately without a visit to the dispenser.

Hearing instruments may incorporate wireless transceivers that enable communication between the two hearing devices typically worn by a user. Such ear-to-ear communication provides the convenience of synchronized adjustments to operating parameters as well enabling binaural signal processing between the hearing instruments. Wireless transceivers may also be used by hearing instruments to enable audio streaming from external sources such as a smartphones. In the case of ear-to-ear communication, the link between the hearing instruments may be implemented as a near-field magnetic induction (NFMI) link operated in a frequency band between 1 and 30 MHz which easily propagates through and around the human head. RF (radio-frequency) links using frequency bands including but not limited to the 900 MHz or 2.4 GHz ISM (Industrial Scientific Medical) bands may also be used in hearing instruments for both ear-to-ear communications and communication with external devices.

Figure 1:
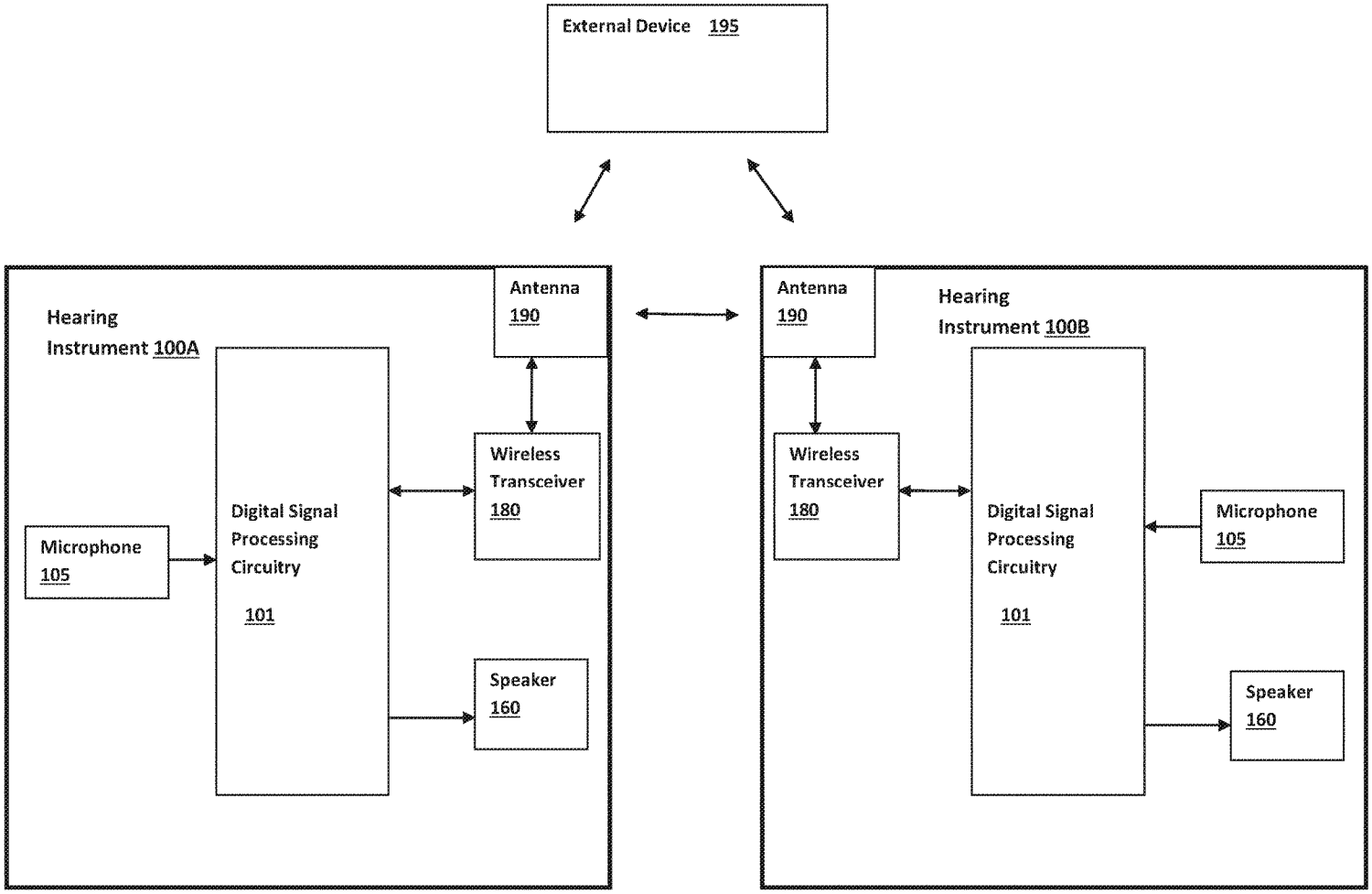
FIG. 1 shows the basic electronic components of example hearing instruments.

FIG. 1 illustrates the basic functional components of an example heating assistance system that includes hearing instrument 100A and hearing instrument 100B for binaural wearing by a user. The components of each hearing instrument are identical and are contained within a housing that may be placed, for example, in the external ear canal or behind the ear. Depending upon the type of hearing instrument, some of the components may be contained in separate housings. A microphone 105 receives sound waves from the environment and converts the sound into an input signal. The input signal is then sampled and digitized by an A/D converter to result in a digitized input signal. The device's processing circuitry 101 processes the digitized input signal into an output signal in a manner that compensates for the patient's hearing deficit. The digital processing circuitry 101 may be implemented in a variety of different ways, such as with an integrated digital signal processor or with a mixture of discrete analog and digital components that include a processor executing programmed instructions contained in a processor-readable storage medium. The processing circuitry 101 also includes a non-volatile memory for the storage of operating parameters. The output signal is then passed to an audio output stage that drives speaker 160 (also referred to as a receiver) to convert the output signal into an audio output. A wireless transceiver 180 is interfaced to the hearing instrument's processing circuitry and connected to the feedpoint of the antenna or antennas 190 for transmitting and/or receiving radio-frequency (RF) signals. The wireless transceiver 180 may enable ear-to-ear communications between the two hearing instruments as well as communications with one or more external devices 195. More than one transceiver may be employed to facilitate both ear to ear communication and long range off body communication, as described in U.S. Patent Application Publication No. 20140023216A1, the disclosure of which is hereby incorporated by reference. When receiving an audio signal from an external source, the wireless receiver 180 may produce one or more second input signals as inputs to the processing circuitry that may be combined with the input signal produced by the microphone 105 or used in place thereof.

In one embodiment, a system that includes two hearing instruments of a binaural pair is configured such that if one of the hearing instruments is lost or damaged and the patient receives a new hearing instrument from the manufacturer or distributor, the new hearing instrument can receive its programming information from the other hearing instrument that was not lost or damaged. In this way, the patient avoids a visit to the dispenser or audiologist's office. To achieve this, the hearing instruments may communicate wirelessly using their respective radio transceivers. For example, the generically programmed new hearing instrument may, after establishing a radio link, send a message to the non-generically programmed hearing instrument requesting programming information for operating as an opposite side hearing instrument. The non-generically programmed hearing instrument would have stored in its non-volatile non-generic programming information for operating on both sides of the patient. Since the already programmed or non-generically programmed hearing instrument already knows its identity as to the side it is currently operating, it transfers the opposite side programming information to the generic hearing instrument. The transferred programming information may include operating parameters relating to hearing loss compensation and/or pairing information such as security keys necessary for communication with external devices such as smart phones (e.g., using secure wireless protocols such as Bluetooth). This will avoid the user from having to re-pair the new hearing instrument with external peripheral communication devices with which the old hearing instrument had been already associated with.

Figure 2:
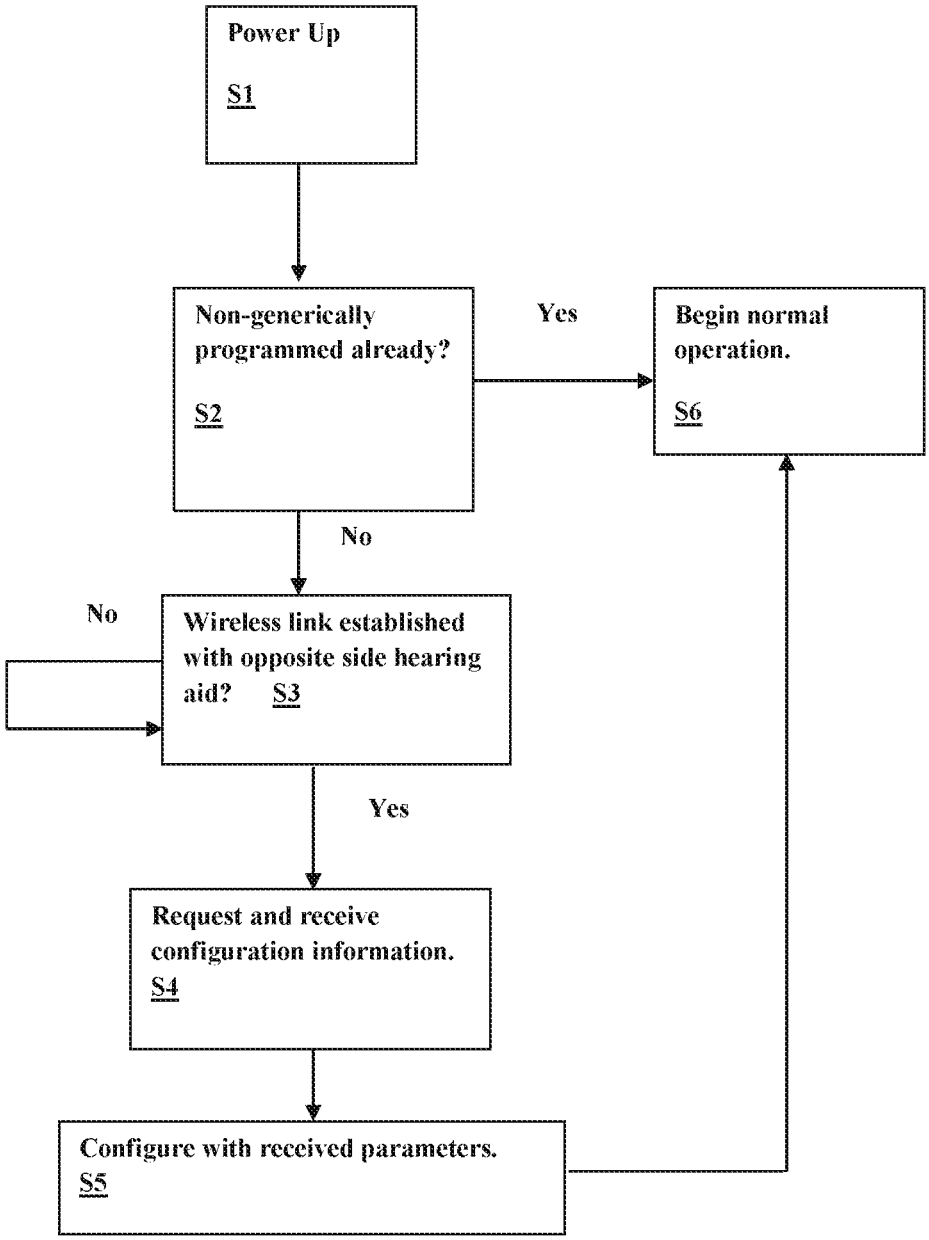
FIG. 2 illustrates an example procedure for wirelessly configuring a generically programmed hearing instrument using parameters stored in another hearing instrument.

FIG. 2 illustrates an example procedure that may be executed by a new generically programmed hearing instrument that is put in operation with an oppositely-sided non-generically programmed hearing instrument. At stage S1, the hearing instrument is powered up. At stage S2, the hearing instrument checks to see whether it has already been individually or non-generically programmed. If so, the hearing instrument begins normal operation at stage S6. If not, establishment of a wireless link with an oppositely sided hearing instrument is attempted at stage S3. After establishment of the link, a request is sent at stage S4 to the oppositely sided hearing instrument to transmit its stored programming information for operating on the side opposite to it. At stage S5, the hearing instrument configures itself with the received programming information and proceeds to normal operation at stage S6.

As mentioned above, the stored programming information received by the generically programmed hearing instrument from the oppositely-sided non-generically programmed hearing instrument may include programming parameters relating to hearing loss compensation. Whether due to a conduction deficit or sensorineural damage, hearing loss in most patients occurs non-uniformly over the audio frequency range, most commonly at high frequencies. Hearing instruments may be designed to compensate for such hearing deficits by amplifying and compressing received sound in a frequency-specific manner, thus acting as a kind of acoustic equalizer that compensates for the abnormal frequency response of the impaired ear. Adjusting a hearing instrument's frequency specific amplification characteristics to achieve a desired level of compensation for an individual patient is referred to as fitting the hearing instrument. One common way of fitting a hearing instrument is by testing the patient with a series of audio tones at different frequencies. The volume of each tone is adjusted to a threshold level at which it is barely perceived by the patient, and the hearing deficit at each tested frequency can be quantified in terms of the gain required to bring the patients hearing threshold to a normal value. For example, if the normal hearing threshold for a particular frequency is 40 dB, and the patient's hearing threshold is 47 dB, 7 dB of amplification gain by the hearing instrument at that frequency results in optimal compensation. A graph of the audible threshold for standardized frequencies as measured by an audiometer is referred to as an audiogram.

The programming information transmitted to the generically programmed hearing instrument may thus include gain settings for different frequency ranges. The programming information may also include parameters relating to the gain applied to the input signal as function of the level of the input signal, a process referred to as compression. Compression involves the processing circuitry dynamically adjusting the amplification in accordance with the amplitude of the input signal to either expand or compress the dynamic range. Compression decreases the gain of the filtering and amplifying circuit at high input signal levels so as to avoid amplifying louder sounds to uncomfortable levels. Such compression may be performed in a frequency-specific manner.

Alternatively, rather than being transmitted as particular parameter settings, the programming information may be transmitted to the generically programmed hearing instrument in the form of an audiogram, where the term audiogram in this case should be understood to mean any information represented by an actual audiogram (e.g., numerical threshold values at different frequencies). The generically programmed hearing instrument may then process the audiogram to derive hearing loss compensation parameters such as frequency-specific gains and compression settings. The audiogram may be transmitted in raw form or in compressed form using conventional data compression techniques. In one particular embodiment, the audiogram is curve-fitted to the patient's audiogram with a polynomial function and then transmitted in the form of a plurality of polynomial coefficients.

In some embodiments, the side-identity (i.e., which side of the patient the hearing instrument should be operated) of each hearing instrument of a binaural pair is programmed into the hearing instrument during initial configuration along with the programming information for both members of the pair. In other embodiments, each hearing instrument is provided with a physical input to indicate is proper side-identity. For example, the physical design of receiver-in-canal (RIC) hearing instruments and behind-the-ear (BTE) hearing allows them to be worn on either side of the head. The two aspects that may specify a side of the head is the ear hook for a BTE hearing instrument and the RIC cable for a RIC hearing instrument. A resistive ID tag in the RIC cable or ear hook may be used identify the side-identity to the hearing instrument so that it would then only look to connect with a hearing instrument having an opposite side-identity. This feature may be used to prevent the hearing instrument from querying other hearing instruments within communication distance that have the same side-identity. The hearing instrument would also select the appropriate parameter from its memory based on the resistive ID value programmed into the RID tag. Each member hearing instrument of a binaural pair may further have a unique pairing ID that a programmed hearing instrument would look for in querying another hearing instrument to verify that they are in fact a proper pair.

Figure 3:
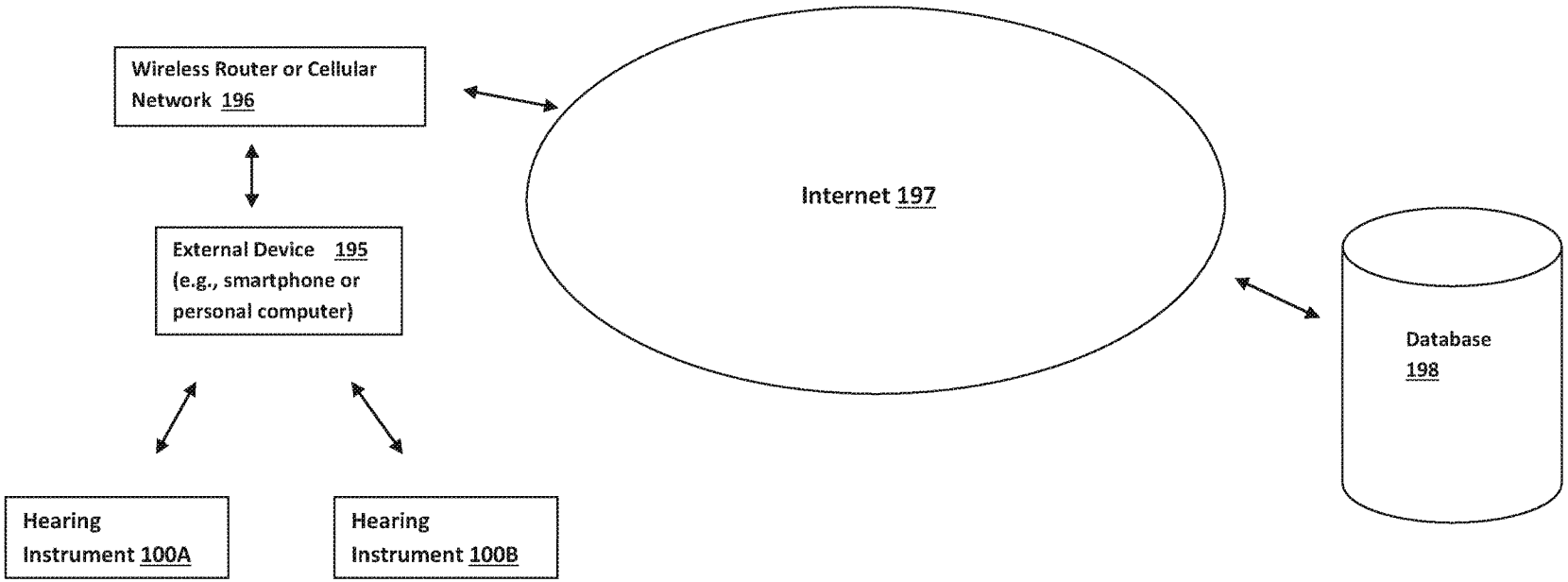
FIG. 3 illustrates a configuration by which a hearing instrument may be wirelessly programmed using an external device such as a smartphone.

In another embodiment, an external device such as a smartphone or computer with wireless communications capabilities may be used to acquire and store the operating parameters of the hearing instruments belonging to a binaural pair. If one member of the pair is lost, the external device could then be used to configure the non-generically programmed replacement hearing instrument. FIG. 3 illustrates a scenario in which programming information is wirelessly loaded to generically programmed hearing instrument 100*a* and/or 100*b* using an external device 195 such as a smart phone or computer. The external device 195 is connected to the internet 197 via a router or cellular network 196 and communicates with a database 198 having the programming information for particular patients stored therein.

As described above, programming information received by a generically programmed hearing instrument from either another hearing instrument or an external device may include programming parameters relating to hearing loss compensation and/or pairing parameters for connecting with external devices. Either in addition to or instead of hearing loss compensation parameters, the received programming information may include one or more of the following: 1) memory settings, 2) telecoil mode settings, 3) tinnitus therapy settings, 4) wireless accessory pairing settings, 5) pairing information for the other hearing instrument in a binaural pair, 6) microphone directionality settings, 7) hearing instrument external switch control information, 8) configuration of device hardware such as volume controls and receiver type, 9) direct audio input configuration, 10) loop system configuration, 11) selected options for audible alerts, and 12) patient identification information.

As described above, in some embodiments a hearing instrument that is a member of a binaural pair may be configured to transfer programming information to the oppositely sided member. In addition to or instead of this operation, a hearing instrument that is a member of a binaural pair may be configured to transfer battery voltage information and/or side sensing information to the opposite member. For example, the opposite member aid could receive the side information from the existing hearing instrument via wireless connection and set itself to the opposite value. In one embodiment, each hearing instrument of a binaural pair would periodically send its voltage values to the opposite hearing instrument which values are saved in memory. For example, if a binaural beam forming mode is dropped due to battery depletion in the right hearing instrument, the left hearing instrument could then tell the user to check the battery specifically in the right hearing aid.

Example Embodiments

In one embodiment, a hearing instrument comprises: processing circuitry for processing an input signal from a microphone into an output signal for driving a speaker; a wireless transceiver connected to the processing circuitry; an antenna connected to the wireless transceiver; wherein the processing circuitry is configured to: operate as a member of a binaural pair of hearing instruments on a first side of the patient using a first set of programming parameters; store programming information relating to a second set of programming parameters for operating on a second side of a patient's head opposite to the first side; and, when requested to do so by a second hearing instrument, wirelessly transmit the stored programming information to the second hearing instrument.

In another embodiment, a hearing instrument comprises: processing circuitry for processing an input signal from a microphone into an output signal for driving a speaker; a wireless transceiver connected to the processing circuitry; an antenna connected to the wireless transceiver; wherein the processing circuitry is configured to: determine whether the hearing instrument is generically programmed or programmed to operate as a member of a binaural pair of hearing instruments on a first side of the patient using a first set of programming parameters; when it is deter mined that the hearing instrument is generically programmed, wireless transmit a request to a second hearing instrument for programming information relating to the first set of programming parameters; and, upon receipt of the programming information, begin operation using the first set of programming parameters.

In another embodiment, a method for operating a hearing instrument comprises: wirelessly connecting with an external device that communicates with a database having programming information stored therein; requesting the external device to access the database to obtain patient-specific programming information; receiving the patient-specific programming information from the external device and beginning operation using the received parameters. The external device may be a smartphone or other type of computing device and may communicate with the database over the internet. The external device may connect to the internet via an internet outer or a cellular network.

In various embodiments, the programming information includes frequency-specific gain settings, compression settings, data representing the patient's audiogram (e.g., numerical values of audible thresholds or coefficients of a polynomial function that represents the patient's audiogram), and/or data for pairing with an external device. The programming information may also include one or more of the following: memory settings, telecoil mode settings, tinnitus therapy settings, wireless accessory pairing settings, pairing information for another hearing instrument in a binaural pair, microphone directionality settings, hearing instrument external switch control information, configuration of device hardware such as volume controls and receiver type, direct audio input configuration, loop system configuration, selected options for audible alerts, and patient identification information.

It is understood that digital hearing instruments include a processor. In digital hearing instruments with a processor, programmable gains may be employed to adjust the hearing instrument output to a wearer's particular hearing impairment. The processor may be a digital signal processor (DSP), microprocessor, microcontroller, other digital logic or analog hardware, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using sub-band processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing assistance devices, including hearing instruments, including but not limited to, behind-the-ear (BTE), in-the-ear (ITE), in-the-canal (ITC), receiver-in-canal (RIC), or completely-in-the-canal (CIC) type hearing instruments. It is understood that behind-the-ear type hearing instruments may include devices that reside substantially behind the ear or over the ear. Such devices may include heating instruments with receivers associated with the electronics portion of the behind-the-ear device, or hearing instruments of the type having receivers in the ear canal of the user, including but not limited to receiver-in-canal (RIC) or receiver-in-the-ear (RITE) designs.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus for a hearing instrument, the apparatus comprising:

processing circuitry for processing an input signal from a microphone into an output signal for driving a speaker;

wherein the processing circuitry is configured to:

operate as a member of a binaural pair of hearing instruments on a first side of a patient using a first set of programming parameters or on a second side of the patient using a second set of programming parameters;

store programming information relating to the first and second sets of programming parameters, wherein the programming information includes a representation of the patient's audiogram on the first and second sides with each of the audiograms being represented by coefficients of a polynomial function; and, operate using either the first set of programming parameters or the second set of programming properties based upon a signal input to the processing circuitry.

2. The apparatus of claim 1, wherein the programming information includes frequency-specific gain settings.

3. The apparatus of claim 1, wherein the programming information includes compression settings.

4. The apparatus of claim 1, wherein the processing circuitry is configured to operate with either the first or the second set of programming parameters as determined by a resistive identification tag inserted into the hearing instrument and wherein the resistive identification tag is incorporated into either a receiver-in-canal (RIC) cable for an RIC hearing instrument or a behind-the-ear (BTE) hook for a BTE hearing instrument.

5. The apparatus of claim 1, wherein the processing circuitry is further configured to, when requested to do so by a second hearing instrument, encode the stored programming information for wireless transmission to a second hearing instrument.

6. The apparatus of claim 1, wherein the programming information includes data for pairing with an external device.

7. The apparatus of claim 1, wherein the programming information includes one or more of the following: memory settings, telecoil mode settings, tinnitus therapy settings, wireless accessory pairing settings, pairing information for another hearing instrument in a binaural pair, microphone directionality settings, hearing instrument external switch control information, configuration of device hardware such as volume controls and receiver type, direct audio input configuration, loop system configuration, selected options for audible alerts, and patient identification information.

8. A hearing instrument, comprising:

processing circuitry for processing an input signal from a microphone into an output signal for driving a speaker;

a wireless transceiver connected to the processing circuitry;

an antenna connected to the wireless transceiver;

wherein the processing circuitry is configured to:

determine whether the hearing instrument is programmed to operate as a member of a binaural pair of hearing instruments on a first side of the patient using a first set of programming parameters or on a second side of the patient using a second set of programming parameters based upon a resistive identification tag inserted into the hearing instrument, wherein the resistive identification tag is incorporated into either a receiver-in-canal (RIC) cable for an RIC hearing instrument or a behind-the-ear (BTE) hook for a BTE hearing instrument;

learn the hearing instrument's side-identity from the resistive identification tag and attempt to wirelessly connect with a second hearing instrument having an opposite side-identity;

when it is determined that the hearing instrument is generically programmed, wirelessly transmit a request to the second hearing instrument for programming information relating to the first set of programming parameters or the second set of programming parameters as indicated by resistive identification tag inserted into the hearing instrument;

upon receipt of the programming information, begin operation using the first or second set of programming parameters.

9. The hearing instrument of claim 8, wherein the programming information includes frequency-specific gain settings.

10. The hearing instrument of claim 8, wherein the programming information includes compression settings.

11. The hearing instrument of claim 8, wherein the programming information is data representing the patient's audiogram.

12. The hearing instrument of claim 8, wherein the programming information includes data for pairing with an external device.

13. The hearing instrument of claim 8, wherein the programming information includes one or more of the following: memory settings, telecoil mode settings, tinnitus therapy settings, wireless accessory pairing settings, pairing information for another hearing instrument in a binaural pair, microphone directionality settings, hearing instrument external switch control information, configuration of device hardware such as volume controls and receiver type, direct audio input configuration, loop system configuration, selected options for audible alerts, and patient identification information.

14. A non-transitory computer-readable medium for storing instructions that, when executed by processing circuitry of a hearing instrument, cause the hearing instrument to:

operate as a member of a binaural pair of hearing instruments on a first side of a patient using a first set of programming parameters or on a second side of the patient using a second set of programming parameters;

store programming information relating to the first and second sets of programming parameters, wherein the programming information includes a representation of the patient's audiogram on the first and second sides with each of the audiograms being represented by coefficients of a polynomial function; and, operate using either the first set of programming parameters or the second set of programming properties based upon a signal input to the processing circuitry.

15. The medium of claim 14, wherein the programming information includes frequency-specific gain settings.

16. The medium of claim 14, wherein the programming information includes compression settings.

17. The medium of claim 14, further comprising instructions to operate with either the first or the second set of programming parameters as determined by a resistive identification tag inserted into the hearing instrument and wherein the resistive identification tag is incorporated into either a receiver-in-canal (RIC) cable for an RIC hearing instrument or a behind-the-ear (BTE) hook for a BTE hearing instrument.

18. The medium of claim 14, further comprising instructions to, when requested to do so by a second hearing instrument, encode the stored programming information for wireless transmission to a second hearing instrument.

19. The medium of claim 14, wherein the programming information includes data for pairing with an external device.

* * * * *